US006360384B1

(12) United States Patent
Kuempel

(10) Patent No.: US 6,360,384 B1
(45) Date of Patent: Mar. 26, 2002

(54) EARTHQUAKE-PROOF SLEEPING PLACE

(76) Inventor: Hans-Joachim Kuempel, Nussallee 8, 53115 Bonn (DE)

( * ) Notice: Subject to any disclaimer, the term of this patent is extended or adjusted under 35 U.S.C. 154(b) by 0 days.

(21) Appl. No.: 09/478,900

(22) Filed: Jan. 7, 2000

(30) Foreign Application Priority Data

Jan. 14, 1999 (DE) ..... 199 01 059

(51) Int. Cl.[7] ..... A47C 21/00
(52) U.S. Cl. ..... 5/414; 5/424; 5/429; 52/167.1
(58) Field of Search ..... 5/1, 284, 414, 5/424, 512, 97, 429, 430; 52/167.1

(56) References Cited

U.S. PATENT DOCUMENTS 1,347,393 A * 7/1920 McCreary ..... 5/97
2,130,703 A * 9/1938 Wylie et al. ..... 5/97
3,583,006 A * 6/1971 Oehms ..... 5/97
5,111,543 A * 5/1992 Epshetsky et al. ..... 5/414
5,575,024 A * 11/1996 You ..... 5/414
5,878,449 A * 3/1999 Belenky et al. ..... 5/414

FOREIGN PATENT DOCUMENTS

| | | |
|---|---|---|
| JP | 08266373 | 3/1995 |
| JP | 08266374 | 3/1995 |
| JP | 08322956 | 5/1995 |

* cited by examiner

*Primary Examiner*—Michael F. Trettel
(74) *Attorney, Agent, or Firm*—Diller, Ramik & Wight

(57) ABSTRACT

The earthquake-proof sleeping place comprises a base frame with arcuate guiding tubes. From each guiding tube, an arcuate supporting bar may be telescoped. The supporting bars may are connected by a longitudinal bar and form a protective frame therewith. Two protective frames can be raised out from the guiding tubes from opposite sides to close above the bed. The protective device requires little space since the base frame is mostly arranged under the bed. Moreover, it provides high stability and supporting safety. An earthquake sensor causes the protective device to be triggered, in which event the protective frames come up.

8 Claims, 4 Drawing Sheets

EARTHQUAKE-PROOF SLEEPING PLACE

BACKGROUND OF THE INVENTION

The present invention refers to an earthquake-proof sleeping place comprising a bed, a base frame and at least one protective frame adapted to be moved upward relative to the base frame.

In areas threatened by earthquakes there is a risk of people being caught in their sleep by an earthquake and being killed or injured by collapsing building parts. To reduce this risk, different sleeping places have been developed that have a protective frame which, triggered by an earthquake sensor rises above the bed and protects the same at least against larger collapsing building masses. Such a sleeping place is described in JP-08 266 374 A. The protective frame is made of spring-loaded parts moved upward and locked when triggered. It surrounds the entire circumference of the bed and thus presents a considerable nuisance that substantially hinders the use of the bed and the making of the bed.

JP-08 266 373 A describes an earthquake-proof sleeping place wherein the bed is normally fastened in a raised position on a frame and is lowered when triggered so that the frame projects vertically above the bed. Again, this only provides protection against larger debris such as concrete ceilings.

JP-08 322 956 A describes a protective frame extending over the bed in the manner of a canopy and being guided in telescopic tubes. The canopy is supported by air bags disposed within the telescopic tubes. These known protective devices for sleeping places are disadvantageous in that they provide such significant changes to the bed that comfort is considerably restricted. Moreover, in many cases, the protective frame only projects upward from the sides of the bed so that medium size debris parts can fall on the bed and the sleeping person.

It is an object of the present invention to provide an earthquake-proof that affects the bed only slightly and that is capable of effectively protecting the bed or a person sleeping therein from parts falling thereon.

SUMMARY OF THE INVENTION

The base frame of the sleeping place according to the present invention is arranged underneath the bed. This means that the major part of the base frame is situated in the region of the vertical projection of the bed, i.e. directly under the bed. The base frame has a guiding track for an arcuate supporting bar of the protective frame. In the withdrawn state of the protective frame, this supporting bar is located in the area of the base frame below the bed. In the extended state of the frame, it is moved upward along the guiding track, covering a part of the width of the bed. Thus, the invention provides not only a cage with side walls, but, as it were, a protective drum with a roof portion.

Preferably, the guiding track consists of the outer tube of a telescope tube, while the supporting bar consists of the inner tube thereof. This allows for a particularly favorable guiding of the supporting bar and for great stability. In this case, the tube telescope may at the same time serve as a piston cylinder unit for pneumatically pushing the inner tube from the outer tube.

At the upper end of the at least one supporting bar, the protective frame may have a longitudinal bar extending in the longitudinal direction of the bed. This longitudinal bar further increases stability. With a plurality of supporting bars present, it interconnects the same to form a rigid supporting frame. The longitudinal bar also reduces the mesh width of the protective frame.

A preferred embodiment of the invention is obtained by providing the base frame with two protective frames that, in the extended state, form a protective device vaulting over the bed. Preferably, this protective device is circular, the base frame, forming the stationary part of the protective device, extending over an angle slightly larger than 120° and each supporting bar also covering about 120°. The supporting bars in their extended state and the base frame combine to form a complete circle. However, it is not necessary for the two protective frames to contact or abut each other when extended. Rather, they may keep a distance from each other.

A substantial increase in security may be obtained by one air bag at least one protective frame, which covers part of the bed in its inflated state. In the event of an earthquake, this air bag is triggered by an earthquake sensor. By covering part of the bed, it protects a person lying in the bed from falling debris.

BRIEF DESCRIPTION OF THE DRAWINGS

The following is a detailed description of preferred embodiments of the present invention given with reference to the accompanying drawings, in which.

DETAILED DESCRIPTION OF PREFERRED EMBODIMENTS

Figure 1:
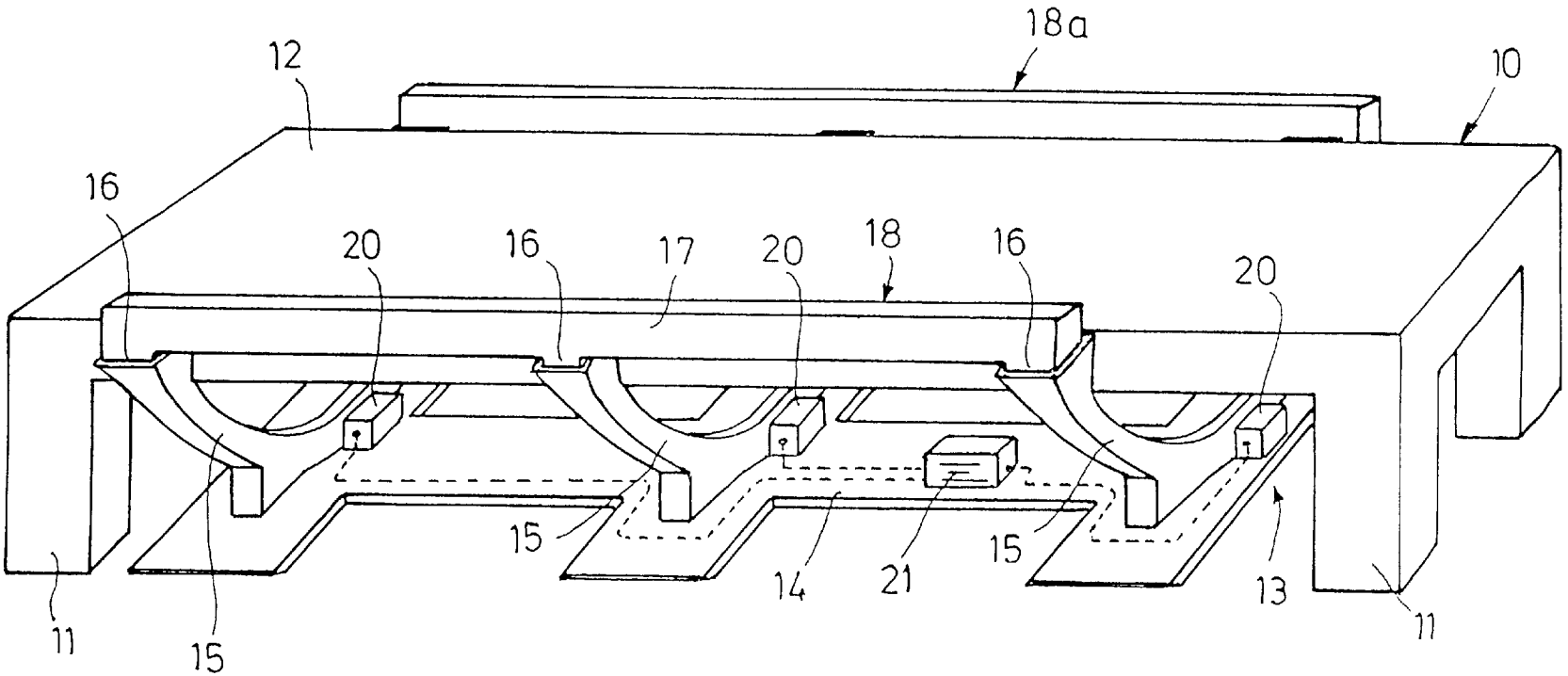
FIG. 1 is a schematic perspective view of the earthquake-proof sleeping place set up for normal use.

The sleeping place comprises a bed 10 resting on legs 11 so that there is a space under the bed 10. The lying surface of the bed is designated as 12.

In the space under the bed 10, a base frame 13 is provided. This comprises a base plate 14 to which three arcuate guiding tube 15 are mounted. Each guiding tube 15 is bent in a vertical plane and curved arcuately, extending over an angular range of slightly more than 120°.

On each side of the bed, arcuate supporting bars 16 are provided, each of which protrudes fittingly into a guiding tube 15. The supporting bars 16 are connected at their upper ends by a longitudinal bar 17. Together with the longitudinal bar, they form a protective frame 18. In the present embodiment, one protective frame 18 is provided on one side of the bed and another protective frame 18*a* is provided on the other side of the bed. The protective bars of the protective frame 18*a* extend into the opposite ends of the guiding tubes 15. The guiding tubes 15 have a rectangular inner cross section, just as the supporting bars 16 have a rectangular outer cross section. The guiding tubes 15 form the outer tube of a telescope tube, while the supporting bars 16 form the inner tube thereof.

Preferably, each arcuate supporting bar 16 extends over an angular range of about 120°. In this case, the supporting bars 16 must overlap in one guiding tube 15 where they are guided in different tracks. Each guiding tube is provided with a pneumatic drive 20 adapted to generate pressure within the guiding tube 15, thereby to push the supporting bar 16 out from the guiding tube. This drive may be a valve connected to a pressure source (not illustrated) or it may be a pressure gas generator pyrotechnically producing a pressure gas when triggered. As an alternative, the drive 20 may be hydraulically or electrically operated.

The drives 20 are actuated by an earthquake sensor 21. This sensor is an acceleration sensor responding to sudden jolts. The earthquake sensor 21 is fastened on the base plate 14 so that the entire device forms a unit that includes all protective and drive elements and is simply set up on the ground. The bed 10 is a separate unit. It is place above the device after the same has been installed.

Figure 2:
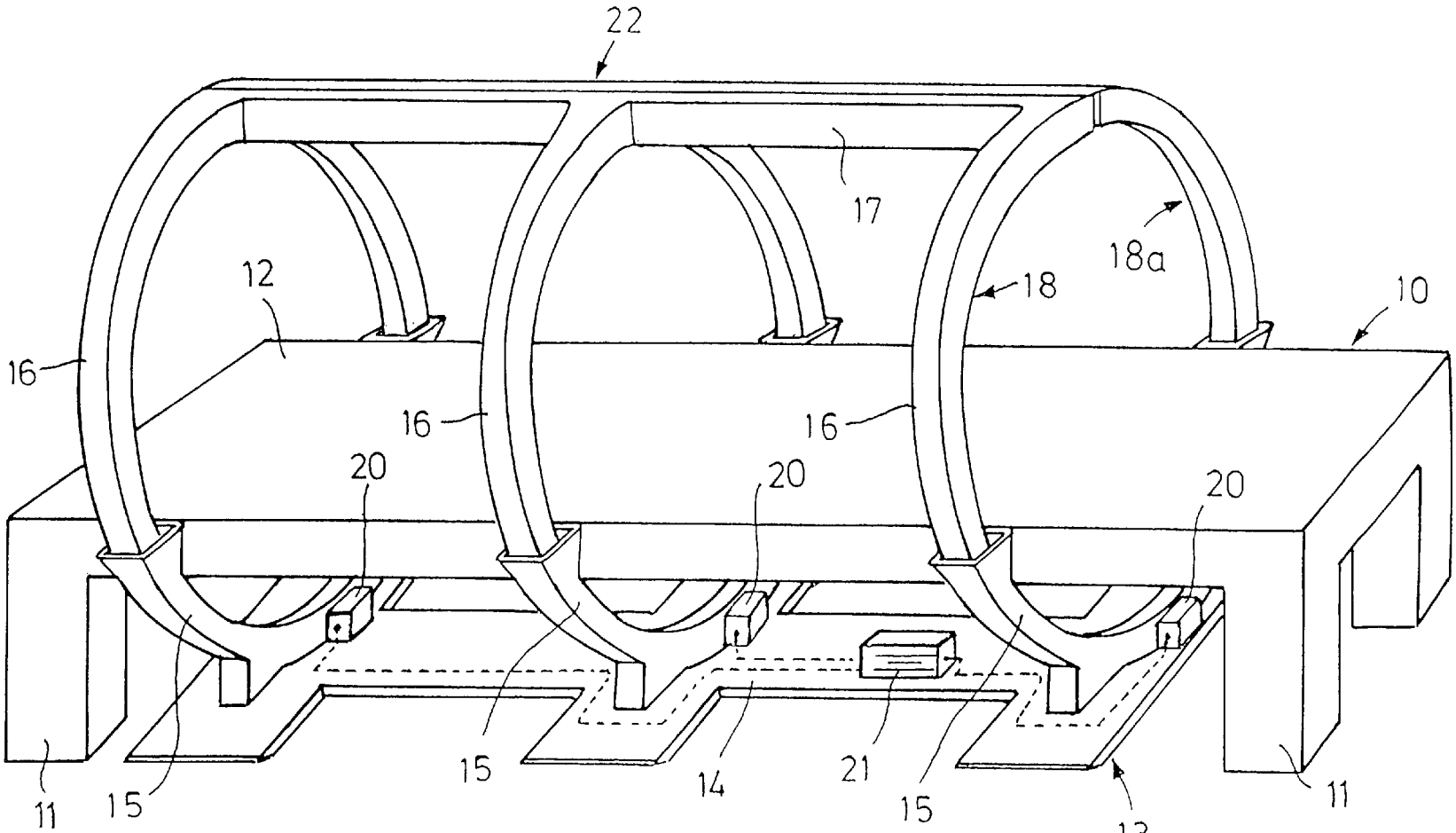
FIG. 2 illustrates the sleeping place of FIG. 1 in the triggered state in which the protective frames cover the bed from the sides.

FIG. 2 illustrates the protective frames 18, 18*a* in the extended state. Here, the protective frames form a protective device 22 spanning over the bed, the longitudinal bars 17 either contacting each other or extending in close side by side relationship. In the present embodiment, the protective frame 22 consists of three rings connected by longitudinal bars 17.

Figure 3:
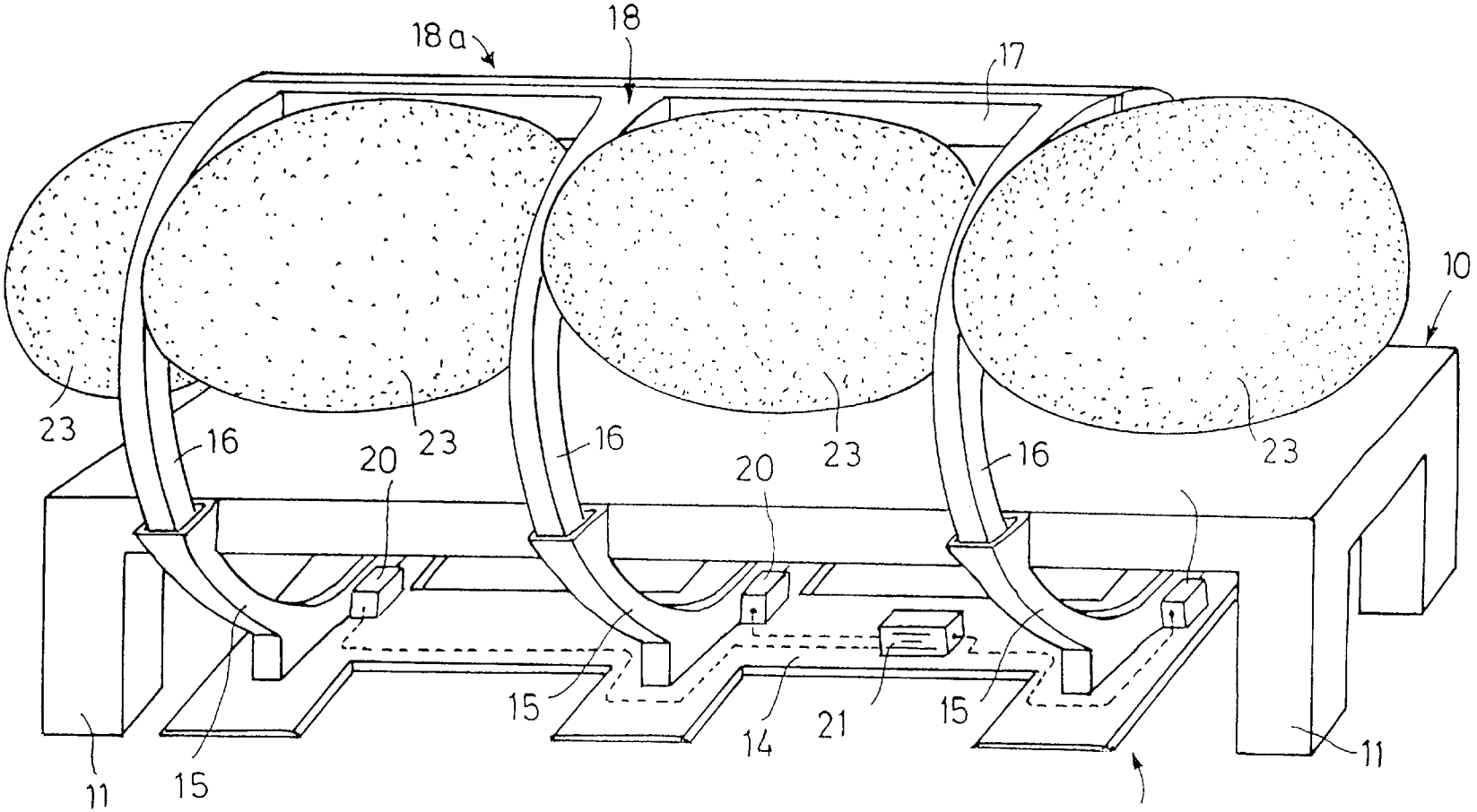
FIG. 3 illustrates the same embodiment with air bags added.

FIG. 3 further shows the provision of air bags 23 at one or both protective frames 18, 18*a*. Preferably, these air bags are mounted below the longitudinal bar 17 and are triggered by the earthquake sensor 21, but only after the corresponding protective frame 18, 18*a* has been extended. Therefore, the inflating devices of the air bag 23 have a delayed response as compared to the drives 20. The air bags 23 are arranged in succession in the longitudinal direction of the bed and each cover a part of the bed or the person lying in the bed.

Figure 4:
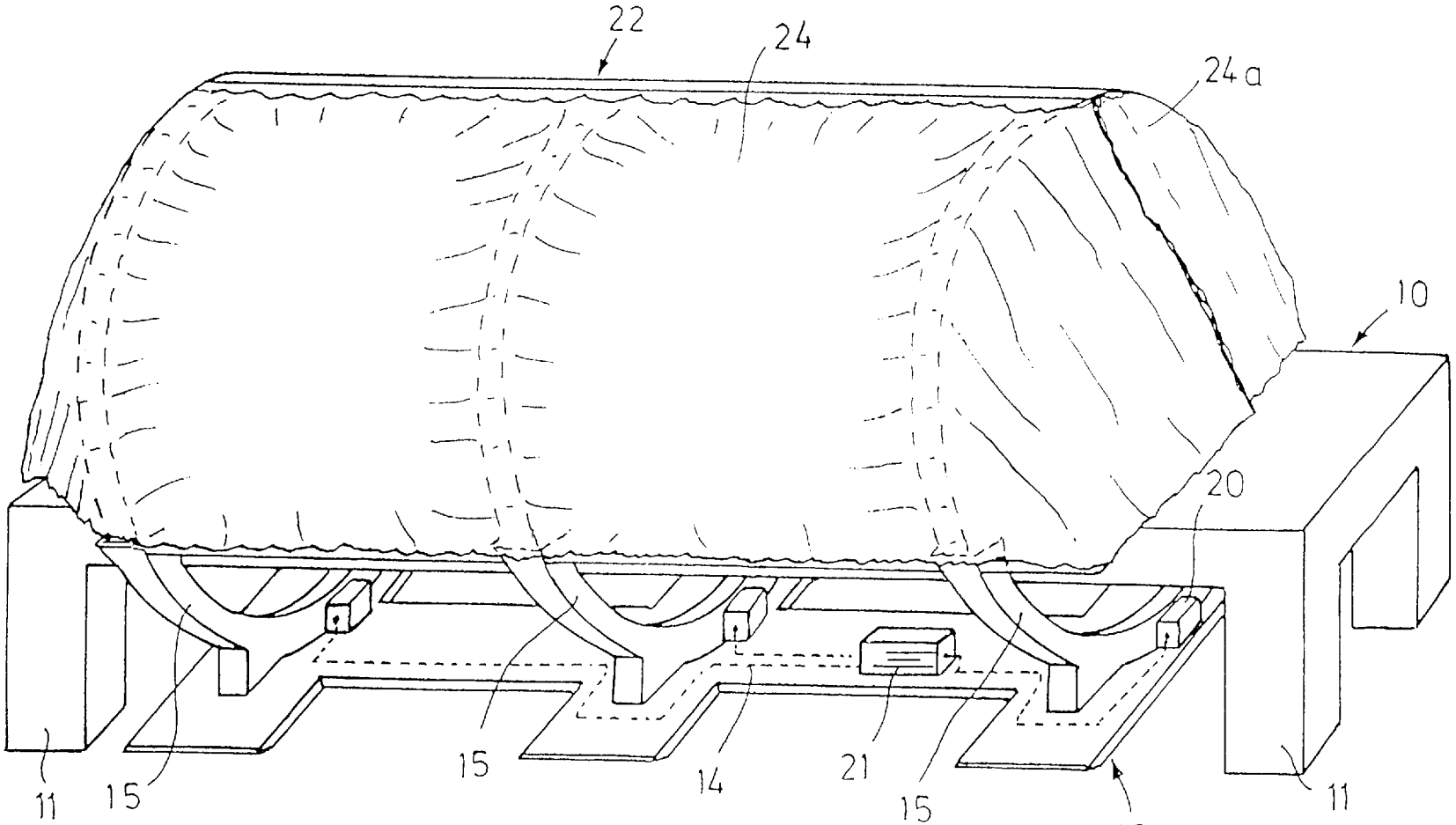
FIG. 4 shows an embodiment with a fire-protection cover sheet.

FIG. 4 illustrates an embodiment, wherein the protective frames 18 and 18*a* are each covered with a cover sheet 24, 24*a* unfolding when the supporting frames are extended and offering protection against smaller debris falling down. The cover sheets 24, 24*a* are made from a non-combustible material so that they also protect the person lying in the bed against smaller fires and flying sparks. For example, the cover sheets are fastened to the longitudinal bars 17 and unfold downward automatically when the protective frames 18, 18*a* come up.

I claim:

1. An earthquake-proof sleeping place comprising a bed, a base frame, and at least one protective frame being raisable relative to the base frame, the base frame including at least one guiding track arranged under the bed for guiding an arcuate supporting bar of the at least one protective frame between a first position substantially underlying the width of the bed and a second position at least partially overlying the width of the bed.

2. The sleeping place as defined in claim 1 wherein the at least one protective frame has a longitudinal bar extending parallel to a longitudinal axis of the bed attached to an upper end of the at least one supporting bar.

3. The sleeping place as defined in claim 1 wherein the base frame includes a second protective frame that form a protective device over the bed when the at least one and second protective frames are raised toward each other to overly a width of the bed.

4. The sleeping place as defined in claim 1 wherein the at least one protective frame includes at least one fire-protective cover sheet.

5. The sleeping place as defined in claim 1 wherein the guiding track is an outer tube of a telescopic tube and the supporting bar is an inner tube of the telescopic tube.

6. The sleeping place as defined in claim 1 wherein the at least one protective frame comprises a pneumatic drive.

7. The sleeping place as defined in claim 1 wherein the at least one protective frame includes an air bag which, when inflated, covers a part of the bed.

8. The sleeping place as defined in claim 1 wherein the drive of the at least one protective frame is adapted to be triggered by an earthquake sensor.

* * * * *